US009581162B2

(12) United States Patent
Yamada et al.

(10) Patent No.: US 9,581,162 B2
(45) Date of Patent: Feb. 28, 2017

(54) COMPRESSOR

(71) Applicant: KABUSHIKI KAISHA TOYOTA JIDOSHOKKI, Kariya-shi, Aichi-ken (JP)

(72) Inventors: Kazuho Yamada, Aichi-ken (JP); Hironao Yokoi, Aichi-ken (JP); Masato Sowa, Aichi-ken (JP); Katsutoshi Shiromaru, Aichi-ken (JP); Fumihiro Suzuki, Aichi-ken (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 242 days.

(21) Appl. No.: 14/324,640

(22) Filed: Jul. 7, 2014

(65) Prior Publication Data

US 2015/0023811 A1 Jan. 22, 2015

(30) Foreign Application Priority Data

Jul. 16, 2013 (JP) ..... 2013-147236

(51) Int. Cl.
*F04C 29/04* (2006.01)
*F04C 29/06* (2006.01)
*F04C 18/12* (2006.01)

(52) U.S. Cl.
CPC ..... *F04C 29/065* (2013.01); *F04C 18/126* (2013.01); *F04C 29/04* (2013.01); *F04C 29/063* (2013.01); *F04C 29/068* (2013.01)

(58) Field of Classification Search
CPC ..... F04B 39/0027; F04B 39/0033; F04B 39/0038; F04B 39/06; F04B 39/064; F04C 29/04; F04C 29/06; F04C 29/063; F04C 29/065; F04C 29/068
USPC ..... 417/312, 243
See application file for complete search history.

(56) References Cited

U.S. PATENT DOCUMENTS 6,733,258 B2 * 5/2004 Okada ..... F04C 29/04 418/181
2009/0232670 A1 * 9/2009 Lai ..... F04C 18/0215 417/312
2012/0201709 A1 * 8/2012 Suzuki ..... F01C 21/10 418/83

FOREIGN PATENT DOCUMENTS

JP 2013-108488 A 6/2013

* cited by examiner

*Primary Examiner* — Charles Freay
*Assistant Examiner* — Philip Stimpert
(74) *Attorney, Agent, or Firm* — Sughrue Mion, PLLC

(57) ABSTRACT

A compressor includes a compression mechanism drawing in, compressing and discharging fluid and a housing accommodating therein the compression mechanism. The housing has therein a discharge chamber into which the fluid compressed by the compression mechanism is discharged. A silencing and cooling device is provided in the discharge chamber to cool the fluid discharged in the discharge chamber and reduce pressure fluctuation. A dispersion wall is provided in the discharge chamber on downstream side of the discharge chamber that is opposite from an inflow port with respect to flowing direction of the discharged fluid. The dispersion wall is disposed to cover a part of the silencing and cooling device and cover at least a part of the inflow port.

4 Claims, 2 Drawing Sheets

COMPRESSOR

BACKGROUND OF THE INVENTION

The present invention relates to a compressor.

In recent years, a compressor is mounted on a vehicle such as a hybrid vehicle, an electric vehicle and a fuel cell vehicle. In such vehicles having a power unit that is silent in operation, a compressor is mounted which develops various noises from inlet port side and outlet port side of the compressor. Such noises are unpleasant to passengers of the vehicle. Therefore, measures that suppress the noise development from a compressor have been proposed. In a fuel cell vehicle using compressed air for power generation by fuel cell, the compressed air needs to be cooled for enhancing power generation efficiency.

Japanese Patent Application Publication No. 2013-108488, for example, describes a compressor having functions of silencing and cooling the fluid (air) discharged after compression. The compressor includes a cylinder block having therein a rotor chamber accommodating a compression mechanism for drawing in, compressing air and then discharging the compressed air and a silencing and cooling chamber accommodating therein an intercooler core for cooling and reducing the pressure fluctuation of the discharged air. The cylinder block has a structure wherein the cylinder block encloses the silencing and cooling chamber and cooperates with a gear housing to enclose the rotor chamber. The rotor chamber and the silencing and cooling chamber are separated by a partition wall that is integrally formed with the cylinder block and communicating with each other through a discharge port formed at a position in the partition wall adjacent to the gear housing. The air compressed by the compression mechanism is discharged with pulsation through the discharge port into the silencing and cooling chamber. Then, the compressed air is flowed through the intercooler core to be cooled there and simultaneously the noise development is lessened by reducing the pressure fluctuation, and the compressed air is discharged from the silencing and cooling chamber to the outside of the compressor.

In the structure of the compressor according to the above Publication, the compressed air flowed through the discharge port is cooled when passing through the intercooler core of the silencing and cooling chamber. However, the compressed air is flowed through only a part of the intercooler core because the discharge port is formed through the partition wall at a position adjacent to the gear housing, so that the compressor has a problem that the compressed air is not sufficiently cooled. Increasing the spaced distance between the discharge port and the intercooler core, the compressed air can be flowed through the entire area of the intercooler core. In this case, the size of the compressor becomes large.

The present invention which has been made in light of such problems is directed to providing a compressor that improves the function of cooling discharged fluid and reducing noise without upsizing the compressor.

SUMMARY OF THE INVENTION

In accordance with an aspect of the present invention, a compressor includes a compression mechanism drawing in, compressing and discharging fluid and a housing accommodating therein the compression mechanism. The housing has therein a discharge chamber into which the fluid compressed by the compression mechanism is discharged. A silencing and cooling device is provided in the discharge chamber to cool the fluid discharged in the discharge chamber and reduce pressure fluctuation. A dispersion wall is provided in the discharge chamber on downstream side of the discharge chamber that is opposite from an inflow port with respect to flowing direction of the discharged fluid. The dispersion wall is disposed to cover a part of the silencing and cooling device and cover at least a part of the inflow port.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

The following will describe embodiments according to the present invention with reference to the accompanying drawings. First, the structure of a compressor 101 according to an embodiment of the present invention will be described. It is note that the following description of the embodiment will focus on a case where the compressor 101 is a roots type air compressor mounted on a vehicle and developing high discharge pulsation.

Figure 1:
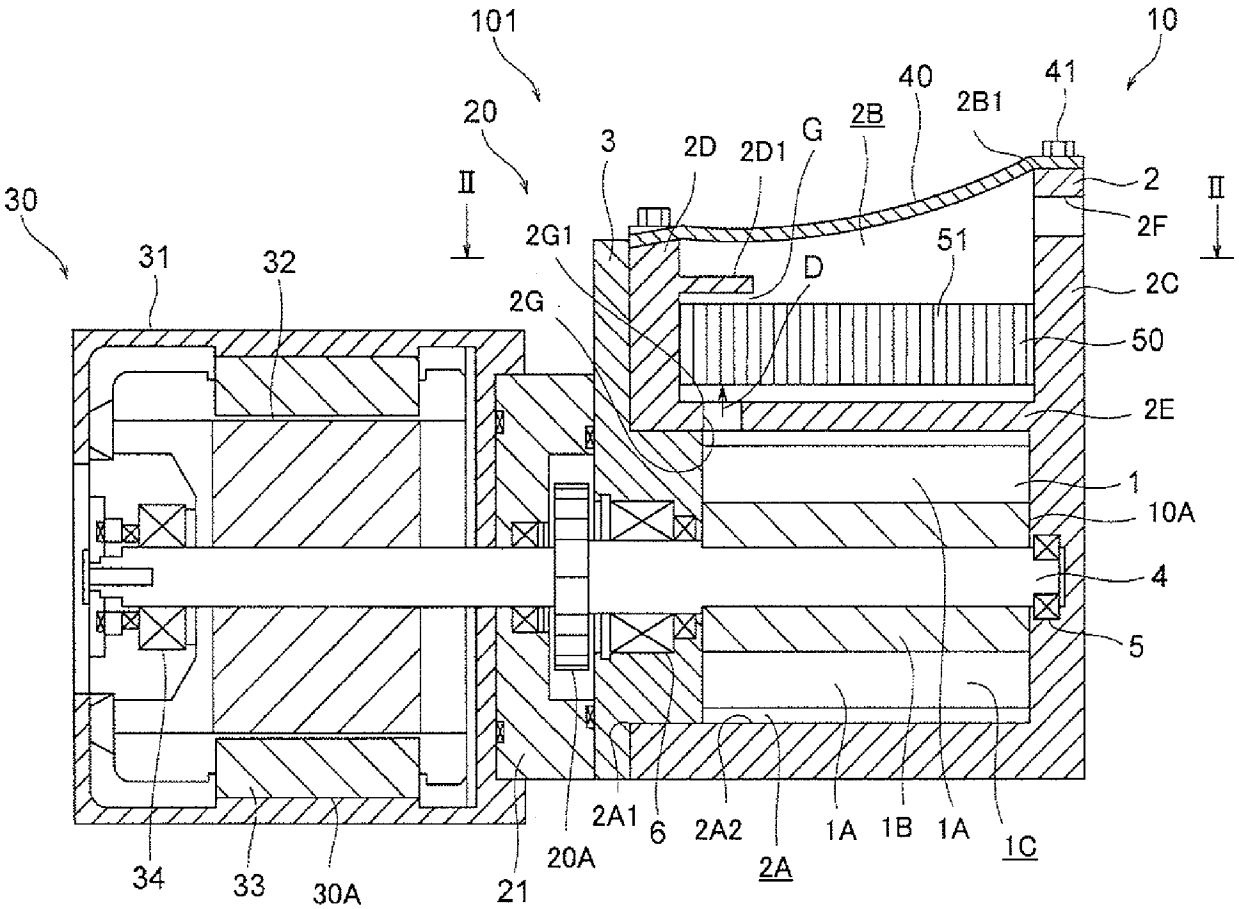
FIG. 1 is a longitudinal sectional view showing a structure of a compressor according to an embodiment of the present invention.

Referring to FIG. 1, the compressor 101 includes a compression mechanism part 10, a drive mechanism part 30 and a gear mechanism part 20. The compression mechanism part 10 includes a compression mechanism 10A having a pair of three lobe type rotors 1 compressing air as fluid. The drive mechanism part 30 includes an electric motor 30A for rotationally driving the rotors 1. The gear mechanism part 20 includes a gear mechanism 20A that is provided between the compression mechanism part 10 and the drive mechanism part 30 and transmits the rotation force of the electric motor 30A to the rotors 1. The compression mechanism part 10, the gear mechanism part 20 and the drive mechanism part 30 are connected together by bolts or the like. As viewed in the axial direction, each three lobe type rotor 1 has three lobes projecting radially outward of the rotor 1. The compression mechanism part 10 includes a compressor housing 2 that has therein a rotor chamber 2A accommodating the two rotors 1 and a discharge chamber 2B in communication with the rotor chamber 2A through a communication hole 2G. The compressor housing 2 is made of an aluminum alloy. The communication hole 2G serves as the inflow port of the present invention.

The communication hole 2G is formed through a partition wall 2E that is a part of the compressor housing 2 and separates the rotor chamber 2A from the discharge chamber 2B. In the compressor housing 2, the rotor chamber 2A has an opening 2A1 that is opened to the gear mechanism part 20. The discharge chamber 2B is of a generally rectangular parallelepiped shape and has an opening 2B1 that is opened perpendicularly to the opening 2A1 of the rotor chamber 2A and faces the partition wall 2E and the communication hole 2G. The communication hole 2G is formed through the partition wall 2E at a position adjacent to the opening 2A1. Furthermore, a discharge port 2F is formed through a side wall 2C of the compressor housing 2 that is located on the side opposite from the opening 2A1 for providing communication between the discharge chamber 2B and the outside of the compressor housing 2. Though not shown in the drawing, a suction port is also formed through the side wall 2C of the compressor housing 2 for communication between the outside of the compressor housing 2 and the rotor chamber 2A.

The compression mechanism part 10 includes a plate-like end plate 3 covering the entire compression mechanism part 10 on the side thereof adjacent to the gear mechanism part 20 so as to close the opening 2A1 of the rotor chamber 2A. The end plate 3 is made of an aluminum alloy. The two rotors 1 are disposed in the rotor chamber 2A closed by the end plate 3 in side by side relation, namely one rotor disposed on the viewer side of the drawing and the other rotor on the opposite side from the viewer of the drawing. Each of the rotors 1 is integrally formed of a cylindrical portion 1B and three ridge-like lobes 1A that project radially outward from the outer periphery of the cylindrical portion 1B and extend along the axis of the cylindrical portion 1B between the side wall 2C and the end plate 3. Each of the rotors 1 is disposed so that the axis thereof extends from the side wall 2C to the end plate 3. The two rotors 1 are disposed meshing with each other in the rotor chamber 2A, so that a plurality of compression spaces 10 is formed between the rotors 1 and the inner peripheral surface 2A2 of the rotor chamber 2A.

A main rotary shaft 4 extends through the rotor 1 disposed on the viewer side of the drawing. The cylindrical portion 1B of the rotor 1 which is located on the viewer side of the drawing is fixedly mounted on the main rotary shaft 4 for rotation therewith. The main rotary shaft 4 extends further through the end plate 3 and the gear housing 21 of the gear mechanism part 20 and in the motor housing 31 of the drive mechanism part 30. The main rotary shaft 4 is rotatably supported through a bearing 5 provided in the compressor housing 2, a bearing 6 provided in the end plate 3 and a bearing 34 provided in the motor housing 31. The compression mechanism 10A includes the rotors 1 and the main rotary shaft 4.

The main rotary shaft 4 also serves as the rotary shaft of the rotor 32 for the electric motor 30A. The rotor 32 having permanent magnets is fixedly mounted on the main rotary shaft 4 for rotation therewith. A stator 33 having a coil is mounted on the inner peripheral surface of the motor housing 31. When the coil of the stator 33 is supplied with AC power, the rotor 32 and the main rotary shaft 4 rotate together by interaction between rotating magnetic field generated by winding wires of the coil and magnetic field generated by the permanent magnets. That is, the rotor 32, the stator 33 and the main rotary shaft 4 cooperate to form the electric motor 30A.

A driven rotary shaft (not shown in the drawing) extends through the rotor 1 disposed on the far side of the drawing from the viewer. The cylindrical portion 1B of the rotor 1 which is located on the far side of the drawing is fixedly mounted on the driven rotary shaft for rotation therewith. The driven rotary shaft extends to the gear housing 21 through the end plate 3 of the compression mechanism part 10. Furthermore, the driven rotary shaft is engaged with the main rotary shaft 4 via the gear mechanism 20A having a plurality of gears in the gear housing 21. Therefore, the rotation of the main rotary shaft 4 by the electric motor 30A is transmitted to the driven shaft through the gear mechanism 20A and the driven rotary shaft is rotated in the direction opposite to the main rotary shaft 4. Thus, the two rotors 1 rotate in the opposite direction to each other.

The rotation of the two rotors 1 in the opposite direction of each other causes air flowed through a suction port (not shown in the drawing) to be trapped in a space formed between the two rotors 1 and the inner peripheral surface 2A2 of the rotor chamber 2A. The air trapped in the space is separated and confined in the compression spaces 1C formed between each rotor 1 and the inner peripheral surface 2A2 by the rotation of the rotors 1. Each compression space 1C rotatably moves with and around the corresponding rotor 1 and the compression spaces 1C of the two rotors 1 converge at a position adjacent to the communication hole 2G. The air converged in the compression spaces 1C is compressed by the lobes 1A of the two rotors 1 while the rotors 1 rotate further and the lobes 1A of the two rotors 1 approach each other. Then, the compressed air is discharged through the communication hole 2G into the discharge chamber 2B.

The opening 2B1 of the discharge chamber 2B facing the partition wall 2E in the compressor housing 2 is closed by a silencing member 40 from outside. The silencing member 40 is fixed to the side walls 2C, 2D, 2H, 2I (refer to FIG. 2) by bolts 41. It is noted that the side wall 2C of the compressor housing 2 is formed higher than the side wall 2D. Therefore, the height of the discharge chamber 2B closed by the silencing member 40 on the side wall 2C side is higher than that on the side wall 2D side. The silencing member 40 serves as the wall member of the present invention.

The silencing member 40 is formed of a laminated plate-like member having a shape similar to a part of an egg shell and recesses toward the partition wall 2E in the discharge chamber 2B. The shell shape of the silencing member 40 enhances the rigidity of the silencing member 40 against the force received from the pulsation of the air or the like from the discharge chamber 2B. The plate-like member forming the silencing member 40 is made of a vibration damping material. As the vibration damping material, the silencing member 40 may use a constrained type damping material such as resin sheet laminated damping steel plate and pasting type laminated material, a non-constrained type damping material such as a metal plate applied with a resin by adhering, coating or spraying, or a damping alloy having vibration absorbing characteristics. As the vibration absorbing alloy, a composite type damping alloy such as flake graphite cast iron, a ferromagnetic type damping alloy using internal friction such as silent alloy (Fe—Cr—Al), a dislocation type damping alloy such as a magnesium alloy, or a twinning deformation type damping alloy such as Mn—Cu alloy may be used. The vibration damping material should have characteristics of loss factor ($\eta$) of 0.01 or more.

A water-cooled intercooler core 50 is disposed in the discharge chamber 2B between the discharge port 2F and the communication hole 2G. The intercooler core 50 includes cooling tubes in which cooling water flows and fins mounted on the cooling tubes. The fins are provided to project into fluid flow region formed between any two adjacent tubes and separate the fluid flow region into a large number of fluid passages 51. The fins increase the heat transfer area between the fluid flowing through the fluid passages 51 and the cooling tubes thereby improving the heat exchange efficiency. The intercooler core 50 serves as the silencing and cooling device of the present invention.

The intercooler core 50 extends in parallel with the partition wall 2E between the silencing member 40 and the partition wall 2E and separates the discharge chamber 2B into the two spaces, namely the partition wall 2E side space and the silencing member 40 side space. Therefore, the air discharged though the communication hole 2G into the discharge chamber 2B is always flowed through the intercooler core 50 and discharged through the discharge port 2F to the outside of the compressor 101. Each fluid passage 51 in the intercooler core 50 extends perpendicularly to the partition wall 2E and parallel to the extending direction of the communication hole 2G.

A dispersion wall 2D1 projects into the discharge chamber 2B on the downstream side of the intercooler core 50 between the silencing member 40 and the intercooler core 50. The dispersion wall 2D1 projects in the discharge chamber 2B from the side wall 2D of the compressor housing 2. That is, the dispersion wall 2D1 is integrally formed with the side wall 2D. Therefore, the rigidity of the dispersion wall 2D1 is high. Furthermore, the dispersion wall 2D1 is spaced from and extends in parallel with the intercooler core 50 to have a small gap G therebetween.

Figure 2:
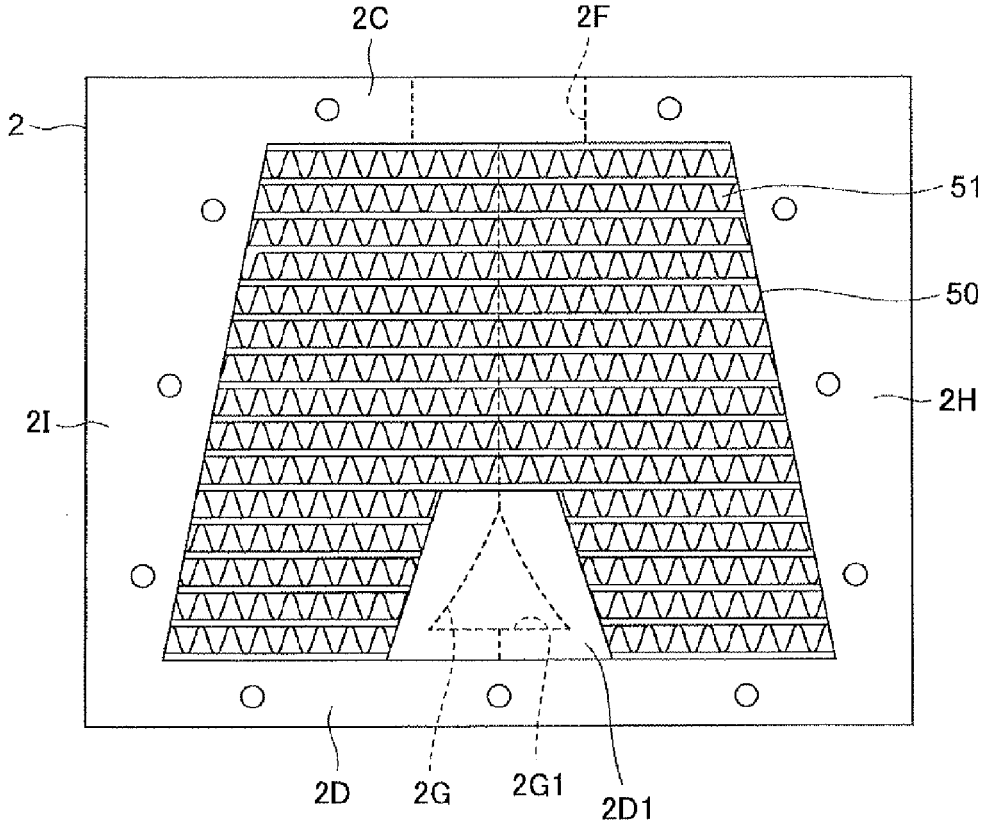
FIG. 2 is a sectional view taken along the line II-II of FIG. 1.

Referring to FIG. 2, the dispersion wall 2D1 is provided so as to cover a part of the intercooler core 50. As viewed in the arrow direction D (FIG. 1) in which the communication hole 2G and the fluid passages 51 in the intercooler core 50 extend, the dispersion wall 2D1 faces an opening 2G1 of the communication hole 2G on the discharge chamber 2B side, at least covers the opening 2G1 and extends in a right angle with the arrow direction D. In the case that the extending direction of the communication hole 2G is different from that of the fluid passages 51, the dispersion wall 2D1 should be provided so as to face the opening of the fluid passages 51 on the side thereof opposite from the opening of the fluid passage 51 adjacent to the opening 2G1 of the communication hole 2G. As viewed along the fluid passages 51, the dispersion wall 2D1 may be at least cover the entire opening of the fluid passages 51 and extend at a right angle to the extending direction of the fluid passages 51.

The following will describe the operation of the compressor 101 according to the embodiment of the present invention. Referring to FIG. 1, when the stator 33 of the electric motor 30A is supplied with AC power, the rotor 32 is driven to rotate by the main rotary shaft 4. Accordingly, the driven rotary shaft (not shown in the drawing) is driven to rotate through the gear mechanism 20A and the two rotors 1 of the compression mechanism 10A are rotated in the opposite directions to each other.

By the rotation of the two rotors 1, air is drawn from the outside of the compressor 101 into the rotor chamber 2A of the compressor housing 2 and confined in the two compression spaces 1C formed by the two rotors 1. The air in the compression spaces 1C converge at a position adjacent to the communication hole 2G. The air is compressed by the lobes 1A of the two rotors 1 and discharged through the communication hole 2G into the discharge chamber 2B. When the two compression spaces 1C converge and are brought into communication with the communication hole 2G, the pulsation occurs in the compressed air being discharged through the communication hole 2G.

The discharged air with the pulsation is mainly flowed in the arrow direction D along the extending direction of the communication hole 2G and changes the flow direction by impinging against the dispersion wall 2D1 after flowing through the intercooler core 50. However, the gap G between the dispersion wall 2D1 and the intercooler core 50 is small, so that the air that has passed through the intercooler core 50 is prevented from flowing out smoothly from the gap G. Therefore, the pressure of the air between the intercooler core 50 and the dispersion wall 2D1, the pressure of the air between the intercooler core 50 and the communication hole 2G and the pressure of the air in a part of the fluid passages 51 of the intercooler core 50 adjacent to the dispersion wall 2D1 and the communication hole 2G are higher than that of the air in the other part of the fluid passages 51. As a result, the air discharged from the communication hole 2G tends to be flowed toward a region between the intercooler core 50 and the partition wall 2E where the pressure is relatively low and then into the intercooler core 50. In the intercooler core 50, the pressure of the air in the fluid passages 51 is highest between the dispersion wall 2D1 and the communication hole 2G and the pressure is gradually reduced with increasing distance from the dispersion wall 2D1 and the communication hole 2G, so that the discharged air from the communication hole 2G is dispersedly flowed over a region apart away from the communication hole 2G between the intercooler core 50 and the partition wall 2E.

As a result, the proportion of the air that flows toward the side wall 2C and the side wall 2H, 2I adjacent to the side wall 2C where the pressure is relatively low and then into the intercooler core 50 increases, with the result that the air discharged out from the communication hole 2G is dispersedly flowed in the entire intercooler core 50. That is, the dispersion wall 2D1 that forms a high-pressure region on the upstream side thereof helps to disperse the discharged air from the communication hole 2G to create a uniform air flow, or rectify air flow, which allows the discharged air to flow in the intercooler core 50 at a decreased speed.

Thus, the discharged air is flowed at a low speed in the intercooler core 50 and dispersed in the entire intercooler core 50. Therefore, the discharged air is cooled by effective heat exchange with the cooling water flowing in the intercooler core 50. Furthermore, the pressure fluctuation and discharge pulsation of the discharged air are reduced by rectifying the air flow in the process in which the discharge air is separately flowed in a lot of fluid passages 51 in the intercooler core 50. As described above, the discharged air from the communication hole 2G is flowed in a state that the flow speed is decreased and the flow is rectified in the entire intercooler core 50. Therefore, the discharged air is effectively cooled and the discharge pulsation is reduced.

The gap G between the intercooler core 50 and the dispersion wall 2D1 may be of such a dimension that the pressure of the discharged air between the dispersion wall 2D1 and the communication hole 2G is increased and the discharged air is dispersed in the entire intercooler core 50. In the case that no gap such as G is present between the intercooler core 50 and the dispersion wall 2D1, no air flows in part of those fluid passages 51 of the intercooler core 50 which are located facing the dispersion wall 2D1, so that utilization loss of the intercooler core 50 occurs. On the other hand, in the case that the dimension of the gap G is too large, the air discharged and passed through the intercooler core 50 diffuses before impinging against the dispersion wall 2D1 and the pressure of the discharged air is decreased in the region between the dispersion wall 2D1 and the communication hole 2G. Therefore, the discharged air through the communication hole 2G tends to flow concentratedly into the fluid passages 51 facing the communication hole 2G and the fluid passages 51 adjacent to the communication hole 2G without being dispersed and rectified. As a result, the loss in utilization of the intercooler core 50 occurs.

Furthermore, the air having flowed through the intercooler core 50 is flowed toward the silencing member 40, impinges against the silencing member 40 to change the flow direction and is discharged through the discharge port 2F to the outside of the discharge chamber 2B. Then, the silencing member 40 made of a vibration damping material absorbs the pulsation or vibration of the impinging air and reduces the noise of the air due to the pulsation. In the discharge chamber 2B, the spaced distance between the silencing member 40 and the partition wall 2E is reduced from the side wall 2C toward the side wall 2D, so that the frequency range of the air that is absorbed by the silencing member 40 is broad. Furthermore, the shell shape of the silencing member 40 that increases the rigidity of the silencing member 40 can suppress its vibration. Additionally, the silencing member 40 made of a material having vibration damping characteristics reduces the radiation of the vibration via the silencing member 40. That is, the discharged air in the discharge chamber 2B is reduced in the pulsation thereof by the intercooler core 50 and the silencing member 40 and is cooled by the intercooler core 50.

Thus, the compressor 101 according to the present invention includes the compression mechanism 10A for suctioning, compressing and discharging air and the compressor housing 2 accommodating the compression mechanism 10A. The compressor housing 2 has therein the discharge chamber 2B into which the air compressed by the compression mechanism 10A is discharged. The compressor 101 further includes the intercooler core 50 and the dispersion wall 2D1. The intercooler core 50 is provided in the discharge chamber 2B, cools the air discharged in the discharge chamber 2B and reduces the pressure fluctuation of the air. The dispersion wall 2D1 is provided in the discharge chamber 2B and located on the opposite side of the intercooler core 50 from the communication hole 2G extending from the compression mechanism 10A to the discharge chamber 2B. That is, the dispersion wall 2D1 is located on the downstream side of the intercooler core 50. The dispersion wall 201 is provided to cover a part of the intercooler core 50 and also at least a part of the communication hole 20.

The air discharged from the communication hole 2G in the discharge chamber 2B is mainly flowed through the intercooler core 50 toward the dispersion wall 2D1 that is disposed in facing relation to the communication hole 2G and impinges against the dispersion wall 201. The pressure in the fluid passages 51 of the intercooler core 50 between the communication hole 2G and the dispersion wall 201 is increased, so that an increasing amount of the air discharged through the communication hole 2G is flowed toward a region between the intercooler core 50 and the partition wall 2E where the air pressure is relatively low and then flowed into the intercooler core 50. Thus, the discharged air is flowed over a broad area in the intercooler core 50. Allowing the discharged air to flow over a broad area in the intercooler core 50, the discharged air can be cooled effectively and the noise of the discharge air can be reduced effectively. In addition, owing to the above-described behavior of the discharged air, the spaced distance between the communication hole 2G and the intercooler core 50 may be small, which helps to downsize the compressor 101.

In the compressor 101, the dispersion wall 201 is disposed with the gap G between the dispersion wall 2D1 and the intercooler core 50 set at such a dimension that the air pressure in a part of the intercooler core 50 facing the dispersion wall 2D1 is greater than that in the other part of the intercooler core 50. Then, the discharged air flowed through the fluid passages 51 of the intercooler core 50 which are located in facing relation to the dispersion wall 2D1 is flowed out from the gap G into the discharge chamber 2B. Thus, the fluid passages 51 facing the dispersion wall 201 can be utilized for cooling the discharged air and reducing the vibration. Furthermore, in the fluid passages 51 and in the downstream thereof, the air pressure is highest in the region facing the dispersion wall 2D1 and gradually decreases with increasing distance from the dispersion wall 201. Therefore, the discharged air can be effectively dispersed in the direction away from the communication hole 2G before being flowed in the intercooler core 50, so that the air is flowed in the entire intercooler core 50. In this case, the air thus dispersed is flowed in the fluid passages 51 of the intercooler core 50 at a reduced flow speed. Therefore, the discharged air can be flowed smoothly in the fluid passage 51 and, therefore, the pressure loss of the discharged air in the intercooler core 50 can be reduced. Even in the case that the amount of the discharge flow is large by the rotation of the compressor 101 at high speed, the vibration of the discharged air can be reduced and the temperature of the discharged air can be lowered due to effective vibration reducing function and cooling function in the entire intercooler core 50.

In the compressor 101, the compressor housing 2 has a wall part enclosing the discharge chamber 2B. The wall part includes the silencing member 40 made of a vibration damping material and disposed at a position that is on the opposite side of the intercooler core 50 from the communication hole 2G. By this arrangement, the vibration of the discharged air flowing in the intercooler core 50 can be reduced by the silencing member 40 and the noise of the discharged air can be further reduced. In the compressor 101, the dispersion wall 2D1 is integrally formed with the side wall 2D enclosing the discharge chamber 2B provided in the compressor housing 2. Therefore, the rigidity of the dispersion wall 2D1 is increased and the noise development due to the vibration of the dispersion wall 2D1 itself caused when the discharged air impinges against the dispersion wall 2D1 is reduced.

Although the silencing member 40 of the compressor 101 according to the present embodiment has a shell shape, the silencing member 40 may have a half-pipe shape curved only in one direction. Such silencing member 40 may have an increased rigidity that reduces the sound radiation from the silencing member 40. Alternatively, the silencing member 40 may be formed flat. Such silencing member 40 can reduce the vibration of the discharged air by the performance of the material characteristics. Although the silencing member 40 of the compressor 101 according to the present embodiment is provided as a member separated from the compressor housing 2, the silencing member 40 may be replaced by a wall part that is integrally formed with the compressor housing 2 and has a shell shape. In this case, the silencing member 40 may be dispensed with and the increased rigidity of the wall can reduce the sound radiation from the wall.

Although the dispersion wall 2D1 of the compressor 101 according to the present embodiment is integrally formed with the compressor housing 2, the dispersion wall 2D1 may be provided separately from the compressor housing 2. Alternatively, a dispersion wall which is made of the same material as the silencing member 40 may be integrally formed with the silencing member 40. The dispersion wall itself can reduce the vibration of the discharged air developed by the discharged air impinging against the dispersion wall. According to the present invention, the water-cooled intercooler core 50 provided in the compressor 101 may be replaced by an air-cooled intercooler core.

Although the compressor 101 according to the present embodiment has therein the gap G between the intercooler core 50 and the dispersion wall 2D1, the gap G may be removed. In this case, the fluid passages 51 in the intercooler core 50 facing the dispersion wall 2D1 can not be effectively used. However, a part of the intercooler core 50 which does not face the dispersion wall 2D1 can be used. In this case, the arrangement of the intercooler core 50 and the dispersion wall 2D1 wherein the part of the intercooler core 50 not facing dispersion wall 2D1 is larger than the part facing the dispersion wall 2D1 is effective for vibration reduction. The dispersion wall 2D1 of the compressor 101 according to the present embodiment is arranged in facing relation to the communication hole 2G through the fluid passages 51 in the intercooler core 50 and so as to cover the entire communication hole 2G through the fluid passages 51. According to the present invention, the dispersion wall 2D1 may be formed and arranged so as to cover at least a part of the communication hole 2G. In this case, since part of the discharged air impinges against the dispersion wall 2D1, the discharged air is dispersed and flowed over a wide range of the intercooler core 50.

According to the present invention, the compressor 101 is not limited to a roots type air compressor, but the present invention is applicable to compressors of any other type such as a screw type compressor or a turbo compressor generating discharge pulsation. Furthermore, the compressor 101 is not limited to an air compressor. The present invention is also applicable to a supercharger or a device compressing fluid such as refrigerant or the like.

What is claimed is:

1. A compressor comprising:

a compression mechanism drawing in, compressing and discharging fluid;

a housing accommodating therein the compression mechanism and having therein a discharge chamber into which the fluid compressed by the compression mechanism is discharged and a discharge port; and a rotary shaft that is rotatably provided in the housing, wherein a silencing and cooling device is provided in the discharge chamber to cool the fluid discharged in the discharge chamber and reduce pressure fluctuation, wherein a dispersion wall is provided between the discharge port and the silencing and cooling device in a radial direction of the rotary shaft in the discharge chamber on a downstream side of the discharge chamber that is opposite from an inflow port for the fluid from the compression mechanism to the discharge chamber with respect to the silencing and cooling device and is arranged within a plane that extends from the housing in an axial direction of the rotary shaft, wherein the dispersion wall is disposed to cover a part of the silencing and cooling device and cover at least a part of the inflow port.

2. The compressor according to claim 1, wherein the dispersion wall is disposed with a gap between the dispersion wall and the silencing and cooling device.

3. The compressor according to claim 1, wherein the housing includes a wall part enclosing the discharge chamber, wherein the wall part includes a wall member made of a vibration damping material and disposed at a position that is on the opposite side of the silencing and cooling device from the inflow port to face the silencing and cooling device.

4. The compressor according to claim 1, wherein the dispersion wall is integrally formed with a wall part enclosing the discharge chamber in the housing.

* * * * *